US010582778B2

(12) United States Patent
Ocegueda Gallaga et al.

(10) Patent No.: US 10,582,778 B2
(45) Date of Patent: Mar. 10, 2020

(54) INFLATABLE AIRBED MATTRESS INTERNAL SUPPORT SYSTEM

(71) Applicant: POLYGROUP MACAU LIMITED (BVI), Road Town, Tortola (VG)

(72) Inventors: Victor Hugo Ocegueda Gallaga, Baja California (MX); Yifeng Zhang, Xinxiang (CN); Chaolong Lan, Shenzhen (CN); Minglian Ma, Shenzhen (CN)

(73) Assignee: POLYGROUP MACAU LIMITED (BVI), Road Town (VG)

( * ) Notice: Subject to any disclaimer, the term of this patent is extended or adjusted under 35 U.S.C. 154(b) by 0 days.

(21) Appl. No.: 15/433,438

(22) Filed: Feb. 15, 2017

(65) Prior Publication Data

US 2018/0027985 A1 Feb. 1, 2018

Related U.S. Application Data

(60) Provisional application No. 62/369,390, filed on Aug. 1, 2016.

(51) Int. Cl.
*A47C 27/08* (2006.01)
*A47C 27/12* (2006.01)

(52) U.S. Cl.
CPC ..... *A47C 27/087* (2013.01); *A47C 27/081* (2013.01); *A47C 27/12* (2013.01); *A47C 27/127* (2013.01); *A47C 27/128* (2013.01)

(58) Field of Classification Search
CPC ... A47C 27/081; A47C 27/087; A47C 27/127; A47C 27/128; A47C 27/121; A47C 27/12
See application file for complete search history.

(56) References Cited

U.S. PATENT DOCUMENTS 379,827 A * 3/1888 Snavely ..... A47C 27/081 5/685
1,282,980 A * 10/1918 Takach ..... A47C 27/081 5/644
1,610,898 A * 12/1926 Steiner ..... A47C 27/081 5/712
2,360,715 A * 10/1944 Hough ..... B60N 2/7052 5/654

(Continued)

FOREIGN PATENT DOCUMENTS

CN 2930467 Y 8/2007
CN 201019353 Y 2/2008

(Continued)

OTHER PUBLICATIONS

International Search Report and Written Opinion from related PCT/US17/42047, dated Aug. 4, 2017, 10 pages.

*Primary Examiner* — Nicholas F Polito
*Assistant Examiner* — Morgan J McClure
(74) *Attorney, Agent, or Firm* — Troutman Sanders LLP; Ryan A. Schneider; Christopher C. Close, Jr.

(57) ABSTRACT

The disclosed technology includes an internal support structure for providing structural stability to an inflated airbed. The internal support structure may include an internal support wall connected to side panels by one or more side support beams. The internal support structure may further include corner support walls and a plurality of internal support beams to provide additional support.

14 Claims, 3 Drawing Sheets

(56) References Cited

U.S. PATENT DOCUMENTS

| | | | | |
|---|---|---|---|---|
| 3,251,075 | A * | 5/1966 | Saltness | A47C 27/081 383/3 |
| 4,181,990 | A | 1/1980 | Santo | |
| 4,349,926 | A | 9/1982 | Winther | |
| 4,425,676 | A * | 1/1984 | Crane | A61G 7/05746 5/689 |
| 4,501,036 | A * | 2/1985 | Santo | A47C 27/081 5/687 |
| 4,513,463 | A * | 4/1985 | Santo | A47C 27/085 5/681 |
| 4,541,135 | A * | 9/1985 | Karpov | A47C 27/081 5/710 |
| 4,644,597 | A | 2/1987 | Walker | |
| 4,700,419 | A * | 10/1987 | Santo | A47C 27/085 5/681 |
| 4,941,223 | A * | 7/1990 | Santo | A47C 27/085 156/217 |
| 5,535,463 | A | 7/1996 | Chiu | |
| 5,598,593 | A * | 2/1997 | Wolfe | A47C 27/081 5/710 |
| 5,608,931 | A * | 3/1997 | Gancy | A47C 27/081 5/711 |
| 6,073,291 | A * | 6/2000 | Davis | A61B 6/0485 414/676 |
| 6,088,859 | A | 7/2000 | Cavazos | |
| 6,568,013 | B2 | 5/2003 | Perez et al. | |
| 7,069,609 | B2 * | 7/2006 | Zheng | A47C 4/54 5/644 |
| 7,089,618 | B1 * | 8/2006 | Metzger | A47C 27/087 5/709 |
| 7,353,555 | B2 * | 4/2008 | Lau | A47C 27/081 5/706 |
| 7,478,448 | B2 | 1/2009 | Boso et al. | |
| 7,591,036 | B2 * | 9/2009 | Lin | A47C 27/087 5/711 |
| 7,610,642 | B2 | 11/2009 | Boyd | |
| 7,636,970 | B2 | 12/2009 | Lin et al. | |
| 8,146,184 | B2 * | 4/2012 | Lin | A47C 21/048 5/417 |
| 8,562,773 | B2 | 10/2013 | Lin et al. | |
| 9,156,203 | B2 | 10/2015 | Lin et al. | |
| 9,247,827 | B2 | 2/2016 | Lin et al. | |
| 9,254,047 | B1 | 2/2016 | Schermel et al. | |
| D765,443 | S | 9/2016 | Lin et al. | |
| 2003/0024050 | A1 * | 2/2003 | Boso | A47C 27/082 5/711 |
| 2003/0101516 | A1 * | 6/2003 | Hsu | A47C 27/081 5/710 |
| 2009/0165211 | A1 * | 7/2009 | Song | A47C 27/081 5/706 |
| 2013/0228268 | A1 | 9/2013 | Lin et al. | |
| 2013/0230670 | A1 | 9/2013 | Lin et al. | |
| 2013/0230671 | A1 | 9/2013 | Lin et al. | |
| 2014/0332139 | A1 | 11/2014 | Lin et al. | |
| 2014/0332142 | A1 | 11/2014 | Lin et al. | |
| 2015/0096126 | A1 * | 4/2015 | Chai | A47C 27/087 5/706 |
| 2015/0201760 | A1 | 7/2015 | Lin et al. | |
| 2015/0335164 | A1 * | 11/2015 | Liu | A47C 27/081 428/12 |

FOREIGN PATENT DOCUMENTS

| | | | |
|---|---|---|---|
| CN | 201032956 | Y | 3/2008 |
| CN | 201599174 | U | 10/2010 |
| CN | 202234135 | U | 5/2012 |
| CN | 102602598 | A | 7/2012 |
| CN | 202536548 | U | 11/2012 |
| CN | 202536827 | U | 11/2012 |
| CN | 102990929 | A | 3/2013 |
| CN | 103110297 | A | 5/2013 |
| CN | 202919638 | U | 5/2013 |
| CN | 203137718 | U | 8/2013 |
| CN | 203137719 | U | 8/2013 |
| CN | 203296407 | U | 11/2013 |
| CN | 103600502 | A | 2/2014 |
| CN | 203735815 | U | 7/2014 |
| CN | 203852092 | U | 10/2014 |
| CN | 102578859 | B | 11/2014 |
| CN | 204218433 | U | 3/2015 |
| CN | 204232695 | U | 4/2015 |
| CN | 102578860 | B | 5/2015 |
| CN | 204599945 | U | 9/2015 |
| CN | 303354844 | S | 9/2015 |
| DE | 202007008326 | U1 | 9/2007 |
| WO | 2013130117 | A1 | 9/2013 |

* cited by examiner

INFLATABLE AIRBED MATTRESS INTERNAL SUPPORT SYSTEM

CROSS-REFERENCE TO PRIORITY CLAIM

This application claims the benefit, under 35 U.S.C. § 119(e), of U.S. Provisional Patent Application No. 62/369,390, filed 1 Aug. 2016, entitled "Inflatable Airbed Mattress Internal Support System," the entire contents and substance of which is incorporated herein by reference in their entirety as if fully set forth below.

TECHNICAL FIELD

Aspects of the present disclosure relate to systems and methods for providing internal support for an airbed, and, more particularly, providing an inflatable airbed having an internal support wall and side support beams.

BACKGROUND

When a user sits or lies on an inflatable airbed, the downward force of the user's mass can cause an increase in the internal pressure of the airbed and a resultant change in shape of the airbed. This increase in internal pressure may cause the shape of the airbed to distort by, for example, creating a shearing force that may cause the walls of the airbed to bow outwards or cause the body of the airbed to slant in one direction. Such distortions may create a sense of imbalance that may affect a user's comfort level when, for example, attempting to sleep on the inflated airbed. Accordingly, to add structural stability to the body of the airbed, some airbed designs include internal structures that attempt to inhibit such distortions. This, however, may cause the airbed to become heavy or cumbersome for a user to handle or carry. Some inflatable airbeds also have a plurality of horizontal chambers that are stacked on top of one another to prevent such shearing forces. But including multiple chambers may increase the cost of production and make the airbed more cumbersome or difficult to inflate.

BRIEF DESCRIPTION OF THE FIGURES

Reference will now be made to the accompanying figures, which are not necessarily drawn to scale, and wherein.

DETAILED DESCRIPTION

Figure 1:
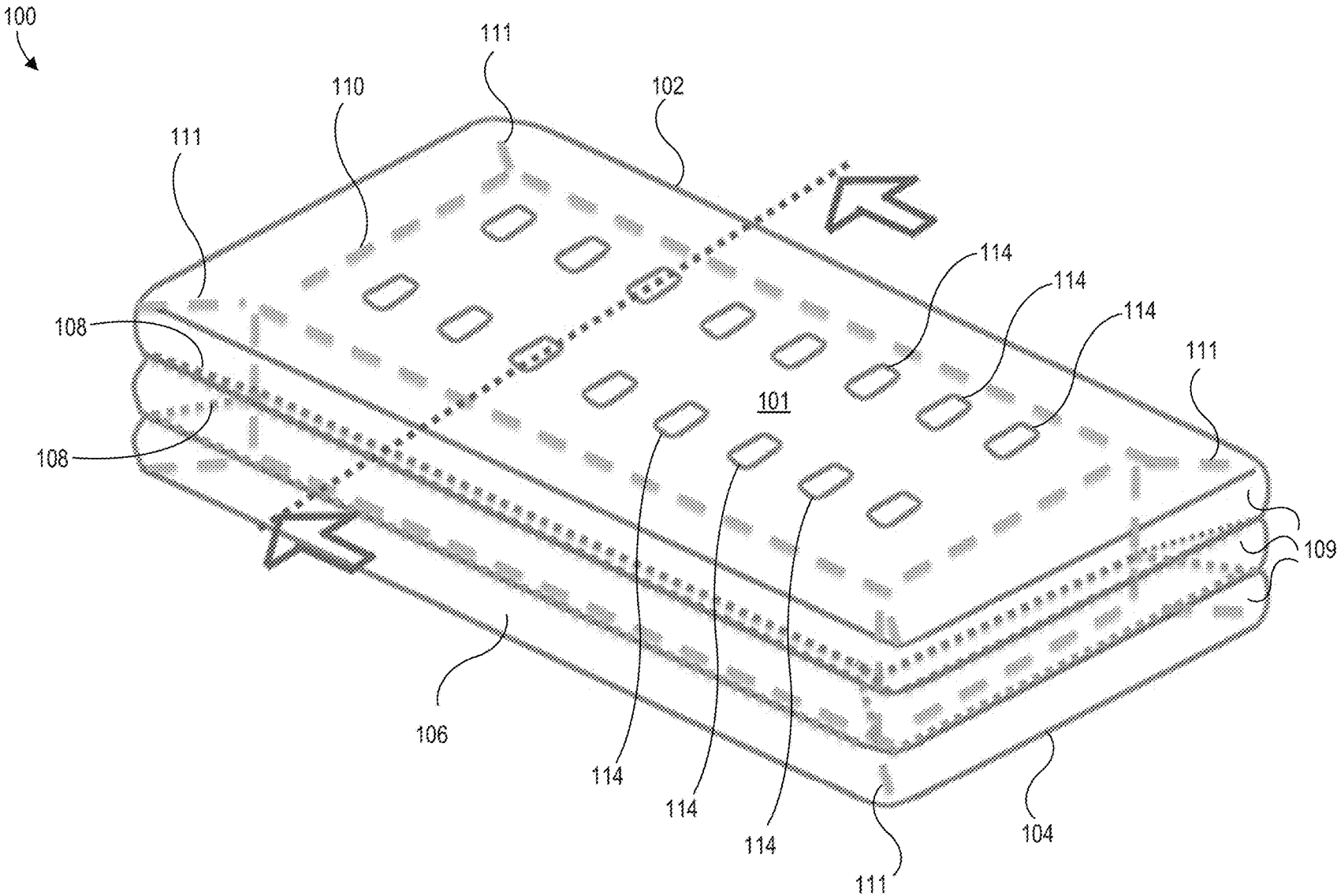
FIG. 1 is a perspective view of an airbed having a side support structure, in accordance with an example embodiment of the presently disclosed subject matter.

The present disclosure can be understood more readily by reference to the following detailed description of example embodiments and the examples included herein. Before the example embodiments of the devices and methods according to the present disclosure are disclosed and described, it is to be understood that embodiments are not limited to those described within this disclosure. Numerous modifications and variations therein will be apparent to those skilled in the art and remain within the scope of the disclosure. It is also to be understood that the terminology used herein is for the purpose of describing specific embodiments only and is not intended to be limiting. Some embodiments of the disclosed technology will be described more fully hereinafter with reference to the accompanying drawings. This disclosed technology may, however, be embodied in many different forms and should not be construed as limited to the embodiments set forth therein.

In the following description, numerous specific details are set forth. But it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used. Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Also, in describing the example embodiments, terminology will be resorted to for the sake of clarity. It is intended that each term contemplates its broadest meaning as understood by those skilled in the art and includes all technical equivalents that operate in a similar manner to accomplish a similar purpose.

To facilitate an understanding of the principles and features of the embodiments of the present disclosure, example embodiments are explained hereinafter with reference to their implementation in an illustrative embodiment. Such illustrative embodiments are not, however, intended to be limiting.

The materials described hereinafter as making up the various elements of the embodiments of the present disclosure are intended to be illustrative and not restrictive. Many suitable materials that would perform the same or a similar function as the materials described herein are intended to be embraced within the scope of the example embodiments. Such other materials not described herein can include, but are not limited to, materials that are developed after the time of the development of the invention, for example.

Embodiments of the disclosed technology include an inflatable airbed having an internal support system for providing structural stability to the airbed. In various embodiments, an inflatable airbed having an internal support system may include one or more side support beams positioned between side panels of the airbed and an internal support wall. According to some embodiments, the internal support structure described herein may prevent distortions in the shape or orientation of the airbed and add stability and support to the structure of the airbed.

Throughout this disclosure, certain embodiments are described in exemplary fashion in relation to an inflatable airbed. But embodiments of the disclosed technology are not so limited. In some embodiments, the disclosed technique may be effective in other inflatable products such as inflatable pillows or inflatable supports.

Referring now to the drawings, FIG. 1 illustrates an example embodiment of an inflatable airbed 100 having an internal support structure 101. In one embodiment, an inflatable airbed 100 may be filled with air or some other gas and used as a mattress. In some embodiments, as shown in FIG. 1, the exterior of the inflatable airbed 100 may be defined by a top panel 102 and a bottom panel 104 that are joined by one or more side panels 106. In some embodiments, a side panel 106 may comprise one or more arc-shaped portions 109 joined together in a generally vertical orientation. In some embodiments the inflatable airbed 100 may include an internal support structure including one or more side support beams 108, an internal support wall 110, internal support beams 212 (shown in FIG. 2), and attachment strips 114. The top panel 102, bottom panel 104, side panels 106, side support beams 108, internal support wall 110, internal support beams 212, attachments strips 114 and any other part of the inflatable airbed 100 or internal support structure 101 described herein may be made of polyvinyl chloride ("PVC"), plastics, rubber, or any other suitable material that is known in the art.

In some embodiments, the inflatable airbed 100 may form a generally rectangular 3-dimensional shape when inflated. The inflatable airbed 100 may include a valve through which air may be pumped into the internal chamber of the airbed 100 or may be released from the internal chamber of the airbed 100. In some embodiments, the inflatable airbed 100 may form an airtight chamber. In some embodiments the side panels 106 may be oriented in a generally vertical position between the top panel 102 and the bottom panel 104.

According to some embodiments, the internal support structure 101 may provide structure and support to the inflatable airbed 100 by providing an internal support wall 110 and one or more side support beams 108. The internal support wall 110 may be configured to provide an internal structure that attaches portions of the top panel 102, bottom panel 104, and side panels 106 to restrict the airbed 100 from deforming out of the desired generally rectangular shape when force is exerted onto the inflated airbed 100. In some embodiments, an internal support wall 110 may be attached to internal surfaces of the top panel 102 and the bottom panel 104. When the airbed 100 is inflated, the internal support wall 110 may extend vertically from the bottom panel 104 to the top panel 102. As shown in FIG. 1, in some embodiments, portions of the internal support wall 110 may be configured to extend along the direction of each side panel 106. Accordingly, in some embodiments, the internal support wall 110 may form a center chamber enclosed within the main chamber formed by the top panel 102, bottom panel 104, and side panels 106, such as the rectangular chamber shown in FIG. 1.

According to some embodiments, the internal support wall 110 may include corner support walls 111 that extend from one or more internal corners of the airbed (i.e., where a lengthwise side panel 106 is joined with a widthwise side panel 106 or, if there only one side panel 106, where a corner is formed in the side panel 106) to one or more corners or sides of the center chamber formed by the internal support wall 110, as shown in FIG. 1. It should be understood that in some embodiments, various aspects of the internal support—such as the internal support wall 110, corner support walls 111, and internal support beams 212 (shown in FIG. 2)—may include apertures that allow air to pass through some or all of the walls or beams so as to allow the internal chambers to fill with air upon inflation of the airbed 100. In some embodiments, the inflatable airbed 100 may include a plurality of internal and external valves that enable each internal chamber formed by the internal support wall 110, corner support walls 111, and internal support beams 212 to be inflated separately from one another.

According to some embodiments, one or more side support beams 108 may provide an internal structure that assists in resisting deformations to the shape of the inflated airbed 100 (e.g., shearing) caused by exertions of force on a surface of the airbed 100. Furthermore, the one or more side support beams 108 may aid in creating a structure that gives the inflatable airbed 100 the external appearance of having a plurality of horizontally stacked internal air chambers (as will be described further in relation to FIG. 2). For example, as shown in FIG. 1, when viewed from the outside, the inflated airbed 100 appears to have three horizontal air chambers that are vertically stacked on one another. In some embodiments, one or more side support beams 108 connects side panels 106 to the internal support wall 110. A side support beam 108 may be a somewhat horizontally oriented beam that may span the length of a side panel 106. In some embodiments, a side support beam 108 may span a portion of the length of a side panel 106 that is less than the full length of the side panel 106. According to some embodiments, each side panel 106 may be connected to one or more side support beams 108, as shown in FIG. 1. In some embodiments, the side support beams 108 may include apertures, which may allow air to easily pass through the side support beams 108 and may decrease the overall weight of the airbed 100.

Figure 2:
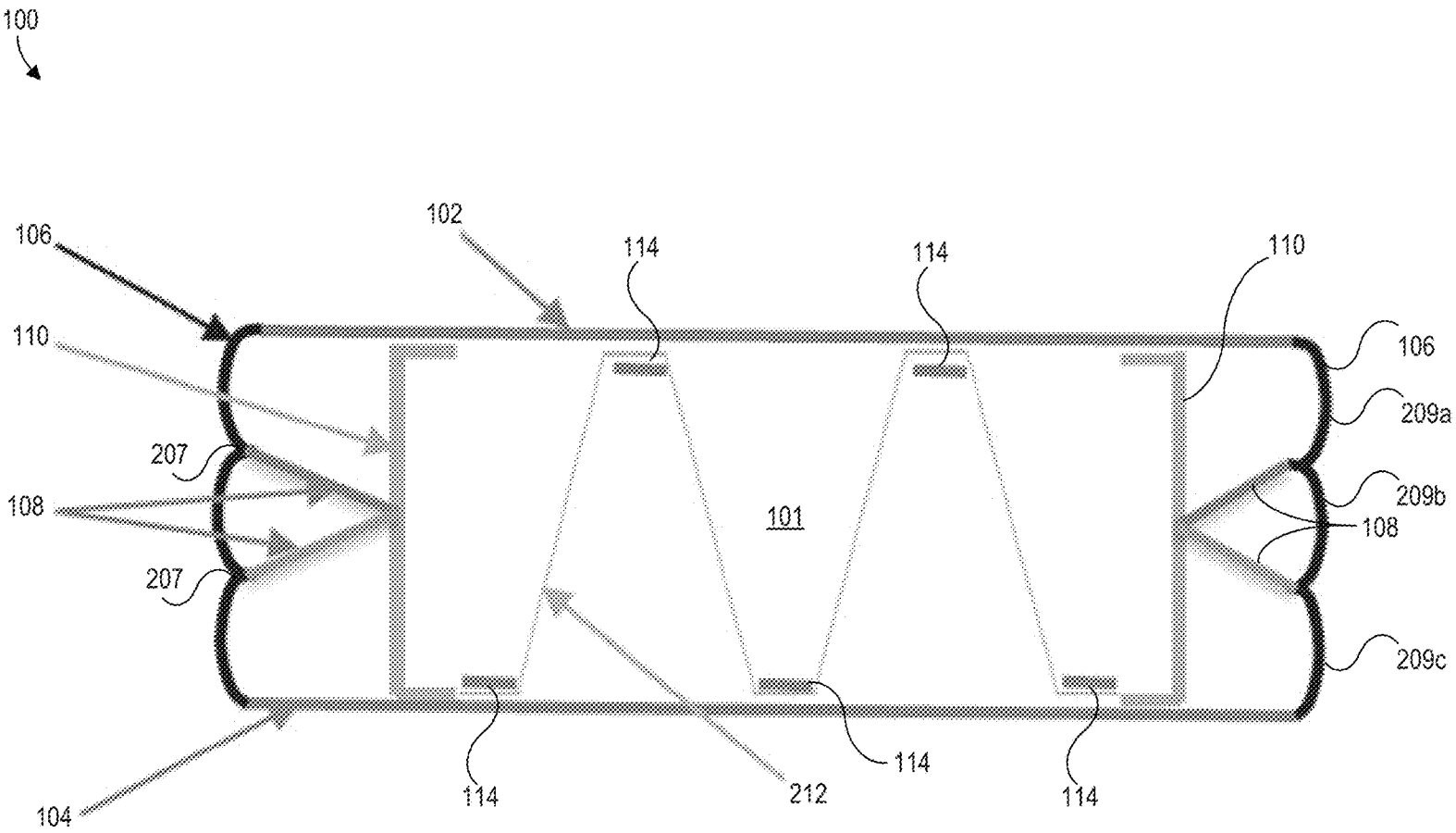
FIG. 2 is a cross-sectional side view of an airbed having a side support structure, in accordance with an example embodiment of the presently disclosed subject matter.

According to some embodiments, the internal support structure may include a plurality of side support beams 108. For example, in some embodiments, as shown in FIG. 2, a first side support beam 108 may extend from a first vertex 207 of a first side panel 106 and a second side support beam 108 may extend from a second vertex 207 from the first side panel. According to some embodiments, the first and second side support beams 108 may attach to an internal support wall 110 at the same location of the internal support wall 110. In contrast, certain embodiments, such as the embodiment shown in FIG. 3, have a first side support beam 308 and a second side support beam 308 that attach to an internal support wall 110 at different locations. Side support beams 108 that can attach to an internal support wall 110 at the same location may allow the airbed to deform or react to internal pressure created by a user's mass resting on the airbed 100 in a different way than that allowed by side support beams 308. Thus, use of one over the other may be preferable depending on the circumstances, such the desired application or the materials used to construct some or all of the parts of the airbed. In embodiments that include corner support walls 111, an edge of a side support beam 108 (or side support beam 308, as the case may be) may attach to the surface of a corner support wall 111, as shown in FIG. 1.

Referring to FIG. 2, the side panels 106 of certain embodiments can include one or more arc-shaped portions 209*a*, 209*b*, 209*c* that may be joined together to form a generally vertically orientated wall. In some embodiments, two adjacent arc-shaped portions may be joined at a vertex 207. Each arc-shaped portion 209*a*, 209*b*, 209*c* may create the visual impression that the airbed 100 includes a plurality of stacked horizontal chambers.

Figure 3:
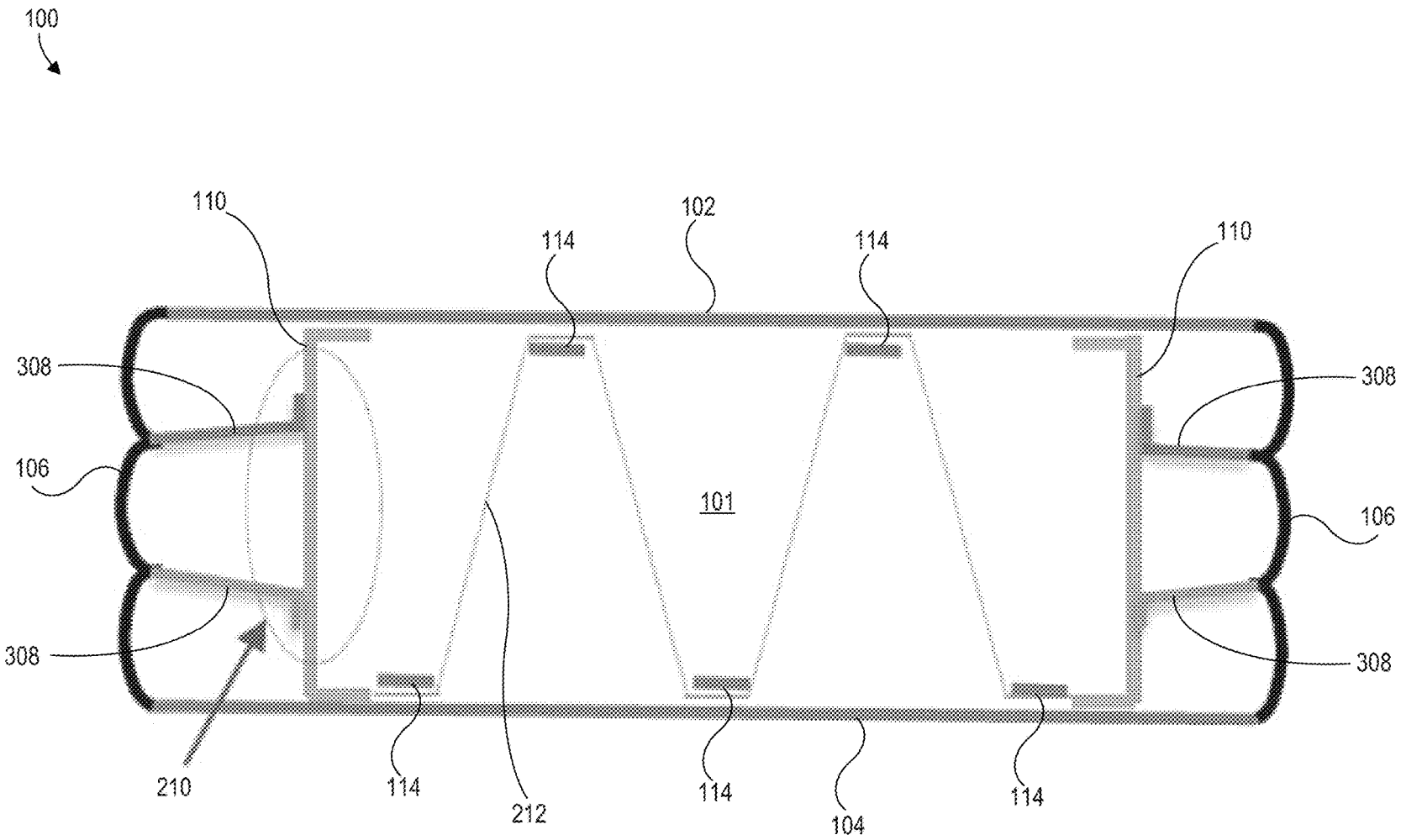
FIG. 3 is a cross-sectional side view of an airbed having a side support structure, in accordance with an example embodiment of the presently disclosed subject matter.

In some embodiments, such as those shown in FIGS. 2 and 3, the internal support structure 101 may further include a plurality of internal support beams 212 that may provide additional structure and support to the airbed 100. In some embodiments, the plurality of internal support beams 212 may be positioned within a center chamber formed by the internal support wall 110. In some embodiments, a plurality of internal support beams 212 may span a length of the inflatable airbed 100. In some embodiments, a plurality of internal support beams 212 may span a width of the inflatable airbed 100. According to some embodiments, one or more pluralities of internal support beams 212 may span either the length or width of the inflatable airbed 100, and form, for example, multiple rows of internal support beams. In some embodiments, one or more pluralities may span across the inflatable airbed 100 diagonally, in relation to the length and width of the airbed 100. The inclusion of multiple rows of internal support beams 212 may provide further stability and structure to an inflated airbed 100 by creating a tension force between the top panel 102 and bottom panel 104 that may tend to cause resistance to horizontal shearing of the airbed 100.

According to some embodiments, each internal support beam 212 may be attached to the top panel 102 and the bottom panel 104. In certain embodiments, the internal support beams 212 are attached directly to the top panel 102 and the bottom panel 104. According to some embodiments, an internal support beam may be affixed to the internal surface of either the top panel 102 or bottom panel 104 by an attachment strip 114. This may provide added strength to the connection between the internal support beam 212 and the top panel 102 or the bottom panel 104, as the case may be. An attachment strip 114 may be, for example, a piece of PVC (or other suitable material) that may be attached (via adhesives, hot gas welding, ultrasonic welding, friction welding, or any other suitable method) to the internal surface of the top panel 102 or the internal surface of the bottom panel 104 to secure at least a portion of an attachment strip 114 to the top panel 102 or bottom panel 104.

According to some embodiments, a separate piece of material may be used to form separate internal support beams 212. In alternate embodiments, a single piece of material may be attached at a plurality of locations on the top panel 102 and bottom panel 104 using a plurality of attachment strips 114 such that a single piece of material may be used to form a plurality of internal support beams 212. Put differently, a single piece of material may comprise a plurality of support beams where the single piece of material is attached at multiple locations on the top panel 102 and bottom panel 104 using multiple attachment strips 114. In some embodiments, the ends of the internal support beams 212 may be attached to internal surfaces of the internal support wall 110.

While certain embodiments of the disclosed technology have been described in connection with what is presently considered to be the most practical embodiments, it is to be understood that the disclosed technology is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the disclosed technology, including the best mode, and also to enable any person skilled in the art to practice certain embodiments of the disclosed technology, including making and using any devices or systems and performing any incorporated methods. The patentable scope of certain embodiments of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An inflatable mattress comprising:

a top panel having an interior surface and an exterior surface;

a bottom panel having an interior surface and an exterior surface;

a plurality of outermost side panels connected to one another and connected to and disposed between the top surface and the bottom surface to form an airtight chamber and define a mattress shape, each of the plurality of outermost side panels having (i) an interior surface, (ii) an exterior surface, and (iii) first, second, and third arc-shaped segments, wherein the first arc-shaped segment and the second arc-shaped segment are joined together at a first vertex, and the second arc-shaped segment and the third arc-shaped segment are joined together at a second vertex;

an internal support wall attached to the interior surface of the top panel and the interior surface of the bottom panel, the internal support wall being air-permeable and forming a central chamber within the airtight chamber that has a shape generally equivalent to the mattress shape, wherein any two adjacent side panels of the plurality of side panels meet to form a corner having an interior surface and an air-permeable corner support wall extends from the interior surface of each corner to a respective corner of the internal support wall;

a first side support beam attached to an attachment point of the internal support wall and to the interior surface of a corresponding side panel of the plurality of outermost side panels at the first vertex of the side panel; and a second side support beam attached to the attachment point of the internal support wall and to the interior surface of the corresponding side panel at the second vertex of the side panel, wherein each of the first and second side support beams is approximately equal to a length of the corresponding side panel.

2. The inflatable mattress of claim 1, wherein the internal support wall is constructed from a single piece of material.

3. The inflatable mattress of claim 1, wherein the internal support wall comprises four distinct panels, each panel comprising a single piece of material.

4. The inflatable mattress of claim 1 further comprising an internal support beam that extends from the interior surface of the bottom panel to the interior surface of the top panel.

5. The inflatable mattress of claim 4, wherein the internal support beam extends between the top panel and the bottom panel at an angle that, when the inflatable mattress is inflated, is non-normal to the top panel and the bottom panel.

6. The inflatable mattress of claim 4, wherein the internal support beam is secured to the interior surface of the bottom panel via a first attachment strip and is secured to the interior surface of the top panel via a second attachment strip.

7. The inflatable mattress of claim 1 further comprising a plurality of internal support beams, each internal support beam extending between the interior surface of the bottom panel and the interior surface of the top panel.

8. The inflatable mattress of claim 7, wherein each internal support beam of the plurality of internal support beams is a separate piece of material.

9. The inflatable mattress of claim 7, wherein the plurality of internal support beams is constructed from a single piece of material.

10. The inflatable mattress of claim 1 further comprising an internal support beam that extends from the internal support wall to the interior surface of the top panel or the interior surface of the bottom panel.

11. The inflatable mattress of claim 1, wherein each side support beam comprises apertures.

12. The inflatable mattress of claim 1, wherein at least one of the first, second, and third arc-shaped segments attaches to the corner support wall.

13. The inflatable mattress of claim 1, wherein the plurality of outermost side panels are connected to one another and connected to and disposed between the top surface and the bottom surface to form a single airtight chamber.

14. An inflatable mattress comprising:

an outer chamber having:

four sides, each side in airtight connection with two adjacent sides and forming a corner with each of the two respective sides, each corner having an interior surface, and each side comprising first, second, and third arc sections, wherein the first arc section and the second arc section are joined together at a first vertex, and the second arc section and the third arc section are joined together at a second vertex;

a top in air-tight connection with the four sides; and a bottom in air-tight connection with the four sides;

an inner chamber having four inner support walls, each of the inner support walls being air-permeable and attached to the top and the bottom, wherein an air-permeable corner support wall extends from a respective interior surface of each corner to a respective corner of the inner chamber; and a first side support member and a second side support member, the first support member being attached to a side of the four sides at the first vertex, the second support member being attached to the side of the four sides at the second vertex, and both of the first and second side support members being attached to an inner support wall at a common attachment point.

* * * * *